US007258708B2

(12) United States Patent
Sung

(10) Patent No.: US 7,258,708 B2
(45) Date of Patent: Aug. 21, 2007

(54) CHEMICAL MECHANICAL POLISHING PAD DRESSER

(76) Inventor: Chien-Min Sung, No. 4, Lane 32, Chung-Cheng Road, Tansui, Taipei County 251 (TW)

( * ) Notice: Subject to any disclaimer, the term of this patent is extended or adjusted under 35 U.S.C. 154(b) by 186 days.

(21) Appl. No.: 11/026,544

(22) Filed: Dec. 30, 2004

(65) Prior Publication Data

US 2006/0143991 A1 Jul. 6, 2006

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24B 21/00*** | (2006.01) |

(52) U.S. Cl. ..... 51/307; 51/309; 51/293; 51/295; 51/298; 451/539; 451/444; 451/443; 451/526

(58) Field of Classification Search ..... 51/307, 51/309, 293, 295, 298, 308; 451/56, 539, 451/444, 443, 526

See application file for complete search history.

(56) References Cited

U.S. PATENT DOCUMENTS

| | | | |
|---|---|---|---|
| 1,941,962 | A | 1/1934 | Tone |
| 2,876,086 | A | 3/1959 | Raymond |
| 3,991,527 | A | 11/1976 | Maran |
| 4,317,660 | A | 3/1982 | Kramis et al. |
| 5,620,489 | A | 4/1997 | Tselesin |
| 6,478,831 | B2 | 11/2002 | Tselesin |
| 6,582,487 | B2 | 6/2003 | Larson et al. |
| 6,752,700 | B2 | 6/2004 | Duescher |
| 6,755,720 | B1 | 6/2004 | Ishizaki et al. |

*Primary Examiner*—Michael Marcheschi
(74) *Attorney, Agent, or Firm*—Thorpe North Western LLP

(57) ABSTRACT

CMP pad dressers and their methods of manufacture are disclosed. One aspect of the present invention provides a CMP pad dresser having improved superabrasive grit retention in a resin layer. The CMP pad includes a resin layer, superabrasive grit held in the resin layer such that an exposed portion of each superabrasive grit protrudes from the resin layer, and a metal coating layer disposed between each superabrasive grit and the resin layer, where the exposed portions are substantially free of the metal coating layer. The metal coating layer acts to increase the retention of the superabrasive grit in the resin layer as compared to superabrasive grit absent the metal coating layer.

53 Claims, 4 Drawing Sheets

CHEMICAL MECHANICAL POLISHING PAD DRESSER

FIELD OF THE INVENTION

The present invention relates generally to a device and methods for dressing or conditioning a chemical mechanical polishing (CMP) pad. Accordingly, the present invention involves the chemical and material science fields.

BACKGROUND OF THE INVENTION

Many industries utilize a chemical mechanical polishing (CMP) process for polishing certain work pieces. Particularly, the computer manufacturing industry relies heavily on CMP processes for polishing wafers of ceramics, silicon, glass, quartz, and metals. Such polishing processes generally entail applying the wafer against a rotating pad made from a durable organic substance such as polyurethane. A chemical slurry is utilized that contains a chemical capable of breaking down the wafer substance and an amount of abrasive particles which act to physically erode the wafer surface. The slurry is continually added to the rotating CMP pad, and the dual chemical and mechanical forces exerted on the wafer cause it to be polished in a desired manner.

Of particular importance to the quality of polishing achieved is the distribution of the abrasive particles throughout the pad. The top of the pad holds the particles by means of fibers or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there is an abundance of open pores available to receive newly applied abrasive particles.

One problem that arises with regard to maintaining the pad surface, however, is an accumulation of polishing debris coming from the work piece, the abrasive slurry, and the pad dresser. This accumulation causes a "glazing" or hardening of the top of the pad, mats the fibers down, and thus makes the pad surface less able to hold the abrasive particles of the slurry. These effects significantly decrease the pad's overall polishing performance. Further, with many pads, the pores used to hold the slurry, become clogged, and the overall asperity of the pad's polishing surface becomes depressed and matted. A CMP pad dresser can be used to revive the pad surface by "combing" or "cutting" it. This process is known as "dressing" or "conditioning" the CMP pad. Many types of devices and processes have been used for this purpose. One such device is a disk with a plurality of superhard crystalline particles such as diamond particles attached to a metal-matrix surface.

Ultra-large-scale integration (ULSI) is a technology that places at least 1 million circuit elements on a single semiconductor chip. In addition to the tremendous density issues that already exist, with the current movement toward size reduction, ULSI has become even more delicate, both in size and materials than ever before. Therefore, the CMP industry has been required to respond by providing polishing materials and techniques that accommodate these advances. For example, lower CMP polishing pressures, smaller size abrasive particles in the slurry, and polishing pads of a size and nature that do not over polish the wafer must be used. Furthermore, pad dressers that cut asperities in the pad which can accommodate the smaller abrasive particles, and that do not overdress the pad must be used.

There are a number of problems in attempting to provide such a pad dresser. First, the superabrasive particles must be significantly smaller than those typically used in currently know dressing operations. Generally speaking, the superabrasive particles are so small that a traditional metal matrix is often unsuitable for holding and retaining them. Further, the smaller size of the superabrasive particles, means that the particle tip height must be precisely leveled in order to uniformly dress the pad. Traditional CMP pad dressers can have particle tip height variations of more than 50 μm without compromising dressing performance. However, such a variation would render a dresser useless if it were required to dress a CMP pad and achieve a uniform asperity depth of 20 μm or less, for example.

In addition to issues with properly holding very small superabrasive particles, the tendencies of metal to warp and buckle during a heating process, cause additional issues in obtaining a CMP pad dresser having superabrasive particle tips leveled to within a narrow tolerance range. While other substrate materials such as polymeric resins have been know, such materials typically are not able to retain superabrasive particles to a degree that is sufficient for CMP pad dressing.

As a result, a CMP pad dresser that is suitable for dressing a CMP pad that meet the demands placed upon the CMP industry by the continual reductions in semiconductor size is still being sought.

SUMMARY OF THE INVENTION

Accordingly, the present invention provides CMP pad dressers and methods that are suitable to groom the CMP pads used for the delicate polishing applications as recited above. In one aspect, such a CMP pad dresser may include a resin layer, and a superabrasive grit held in the resin layer. It has been discovered that retention of the superabrasive particles in the resin layer may be improved by disposing a metal coating layer between at least a portion of each superabrasive grit and the resin layer as compared to superabrasive grit absent such a metal coating layer. An exposed portion of the superabrasive grit can protrude at least partially from the resin layer, and can protrude substantially to a predetermined height. The metal coating layer can extend substantially along each superabrasive grit and resin layer interface, and the protruding portion of the superabrasive grit can be substantially free of the metal coating layer. Furthermore, the metal coating layer can be chemically bonded to at least a portion of each superabrasive grit, and the metal coating layer can in turn, be mechanically bonded to at least a portion of the resin layer.

The present invention additionally encompasses methods of improving retention of superabrasive grit held according to a predetermined pattern in a solidified resin layer. Such methods may include disposing a metal coating layer between at least a portion of each superabrasive grit and the resin layer such that each superabrasive grit includes an exposed portion that protrudes at least partially from the resin layer. The exposed portion may be substantially free of the metal coating layer. The metal coating layer may have a surface that provides increased mechanical bonding with the resin layer.

The present invention further encompasses methods of making a CMP pad dresser having the improved grit retention and performance characteristics recited herein. In one aspect, such a method can include disposing superabrasive grit in a resin layer such that each superabrasive grit has an exposed portion that protrudes at least partially from the resin layer. The superabrasive grit can include a metal coating layer disposed between at least a portion of the superabrasive grit and the resin layer. The exposed portion of each superabrasive grit may be substantially free of the metal coating layer. Also, the superabrasive grit can be situated such that they protrude essentially to a predetermined height.

A variety of methods may be used in order to effect placement of the superabrasive grit in accordance with the predetermined pattern. However, in one aspect, the superabrasive grit can be disposed in the resin layer by providing a temporary substrate having a working surface, applying a spacer layer to the working surface of the temporary substrate. Superabrasive grit may be at least partially disposed in the spacer layer, and may protrude at least partially from the spacer layer opposite the working surface of the temporary substrate. An at least partially uncured resin material can be applied to the spacer layer opposite the working surface of the temporary substrate, and then cured to secure the superabrasive grit. The temporary substrate and the spacer layer can be removed to expose the protruding superabrasive grit.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Definitions

Figure 1:
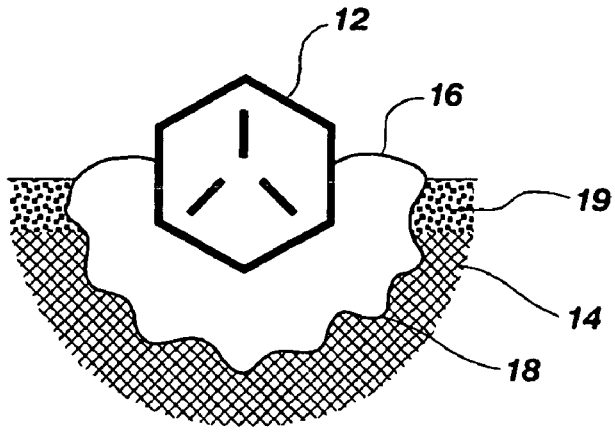
FIG. 1 is a cross-section view of a superabrasive particle embedded in a resin layer in accordance with one embodiment of the present invention.

In describing and claiming the present invention, the following terminology will be used in accordance with the definitions set forth below.

The singular forms "a," "an," and, "the" include plural referents unless the context clearly dictates otherwise. Thus, for example, reference to "a particle" includes reference to one or more of such particles, and reference to "the resin" includes reference to one or more of such resins.

As used herein, "resin" refers to a semisolid or solid complex amorphous mix of organic compounds. As such, "resin layer" refers to a layer of a semisolid or solid complex amorphous mix of organic compounds. Preferably the resin will be a polymer or copolymer formed from the polymerization of one or more monomers.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "metal coating layer" and "metal layer" may be used interchangeably, and refer to a continuous or discontinuous metal coating applied to at least a portion of a superabrasive particle.

As used herein, "metallic" refers to a metal, or an alloy of two or more metals. A wide variety of metallic materials is known to those skilled in the art, such as aluminum, copper, chromium, iron, steel, stainless steel, titanium, tungsten, zinc, zirconium, molybdenum, etc., including alloys and compounds thereof.

As used herein, "particle" and "grit" may be used interchangeably, and when used in connection with a superabrasive material, refer to a particulate form of such material. Such particles or grit may take a variety of shapes, including round, oblong, square, euhedral, etc., as well as a number of specific mesh sizes. As is known in the art, "mesh" refers to the number of holes per unit area as in the case of U.S. meshes.

As used herein, "metallurgical bond" refers to a bond between two or more metals. Such bonds may be a simple mechanical lock or bond between the metals, such as one created by the intertwining of liquid metals and the solidification thereof. Further, such bonds may be chemical in nature, such as typical ionic bonding that occurs between metals.

As used herein, "chemical bond" and "chemical bonding" may be used interchangeably, and refer to a molecular bond that exert an attractive force between atoms that is sufficiently strong to create a binary solid compound at an interface between the atoms. Chemical bonds involved in the present invention are typically carbides in the case of diamond superabrasive particles, or nitrides or borides in the case of cubic boron nitride.

As used herein, "mechanical bond" and "mechanical bonding" may be used interchangeably, and refer to a bond interface between two objects or layers formed primarily by frictional forces. In some cases the frictional forces between the bonded objects may be increased by expanding the contacting surface areas between the objects, and by imposing other specific geometrical and physical configurations, such as substantially surrounding one object with another.

As used herein, "braze alloy" and "brazing alloy" may be used interchangeably, and refer to an alloy containing a sufficient amount of a reactive element to allow the formation of chemical bonds between the alloy and a superabrasive particle. The alloy may be either a solid or liquid solution of a metal carrier solvent having a reactive element solute therein. Moreover, "brazed" may be used to refer to the formation of chemical bonds between a superabrasive particle and a braze alloy.

As used herein, "coat," "coating," and "coated," with respect to a superabrasive grit or particle, refers to an area along at least a portion of an outer surface of the particle that has been intimately contacted with a reactive metal, or reactive metal alloy, and that contains chemical bonds between the particle and the alloy, or that will contain such chemical bonds upon the liquification and solidification of the reactive metal, or reactive metal alloy. In some aspects, the coating may be a layer which substantially encases or encloses the entire superabrasive particle. It is to be understood that such layers are limited in some instances to a certain minimum thickness. Further, it is to be understood that such a coating may be applied to particles on an individual basis, or as a group of particles, and that such a coating may be effected as a separate step made prior to incorporation of the superabrasive particles into a tool, for example, in order to form a tool precursor which can be combined with a support matrix to form certain tools. Moreover, it is possible that a number of coated particles be consolidated together, either with or without additional abrasive particles and used as a tool in and of themselves, without the need for incorporation into a support matrix.

Concentrations, amounts, solubilities, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a concentration range of 1 to 5 should be interpreted to include not only the explicitly recited limits of 1 and 5, but also to include individual values such as 2, 7, 3.6, 4.2, and sub-ranges such as 1-2.5, 1.8-3.2, 2.6-4.9, etc. This interpretation should apply regardless of the breadth of the range or the characteristic being described, and also applies to open-ended ranges reciting only one end point, such as "greater than 25," or "less than 10".

THE INVENTION

The present invention provides resin-based CMP pad dressers including methods for their use and manufacture. The inventor has found that the retention of a superabrasive particle in a resin layer can be improved by disposing a metal coating layer between the superabrasive particle and the resin layer. FIG. 1 shows a superabrasive particle 12 embedded in a resin layer 14. A metal coating layer 16 is disposed between the superabrasive particle 12 and the resin layer 14. The metal coating layer 16 can provide improved mechanical bonding with the resin layer 14 as compared to the relatively smooth and inert surface of a superabrasive material such as diamond. In one aspect, the metal coating layer 16 may have a bonding surface 18 that provides increased mechanical bonding by the resin layer 14 as compared to the resin layer bonding directly to the surface of a superabrasive particle. By utilizing metal coating layers with relatively rough textures on the bonding surface, mechanical bonding between the superabrasive particle and the metal coating layer can be further improved. In one aspect, retention may also be improved by arranging the superabrasive grit according to a predetermined pattern. Such arrangements may apportion to each superabrasive grit a sufficient amount of resin layer material to improve retention. In another aspect of the present invention, a reinforcing material 19 may be added to at least a portion of the resin layer to increase superabrasive grit retention.

In certain working environments it may be highly desirable or even critical to avoid contaminating the work piece with metals. As such, in one aspect of the present invention, the metal coating layer coating the superabrasive particle does not extend substantially past the surface of the resin layer. In other words, the exposed portion of each superabrasive grit that protrudes from the resin layer may be substantially free of the metal coating layer, thus allowing the surface of the superabrasive grit to come in contact with the work piece rather than the metal coating layer. This configuration may be particularly useful in CMP applications where metal flakes may cause damage to the wafer being polished.

It should be noted that the present invention is not limited to particular metals or combinations of metals. The general idea of improving the retention of a superabrasive particle in a resin layer by utilizing an intermediate metal coating layer would naturally encompass numerous variations that would be apparent to one skilled in the art once in possession of the present invention, and should be considered to be included herein. In one aspect of the present invention, the metal coating layer may be a coating on the superabrasive particle. The coating may be accomplished in a single layer, or by the production of multiple layers. In one aspect, the metal coating layer may be applied via gaseous vapor deposition techniques, electroplating, sintering, brazing, or any other metal coating means known to one of ordinary skill in the art. The metal can be provided as a pure metal, a metal composite, or a metal alloy. Because many types of superabrasive particles can be damaged by very high temperatures, metal alloy with a lower melting temperature may be useful. In one aspect, the metal coating layer may be a coating that entirely surrounds the superabrasive particles. The metal coating layer may then be etched away from the exposed portion of the superabrasive grit. In another aspect, the metal coating layer may not be a continuous coating, but may extend essentially along only each superabrasive grit and resin layer interface, thus facilitating increased retention in the resin layer. In yet another aspect of the present invention, the metal coating layer may comprise multiple metal coating layers in any combination of essentially pure metals, metal composites, and metal alloys.

Any metal or metal containing compound known to one skilled in the art that improves retention in a resin layer is considered to be within the scope of the present invention. Examples of metals useful to the present invention include, but are not limited to, copper (Cu), cobalt (Co), and nickel (Ni), including associated alloys and mixtures such as Ni—P, Ni—B, where P (phosphorus) or B (boron) may be incorporated from a solution such as that used for electroless coating. Metal coatings may also include co-precipitated mixtures of Ni—W and Co—Mo. In one aspect, multiple coatings may be employed, such as by first coating with a thin layer (e.g. 0.5 micron) of Ti or Cr or Si by vacuum deposition, and followed by electroless coating of Ni—P or Ni—W—P. Moreover, an inner carbide former coating may be heat treated to react with the superabrasive particle to form chemical bonds, thus increasing adherence. In another aspect, a molten braze coating may be employed as described in copending U.S. Pat. No. 6,830,598; and in U.S. patent application Ser. No. 10/627,441 filed on Jul. 25, 2003, published as US2005/0230155, both of which are hereby incorporated by reference in their entirety. Also an organometallic coupling agent may be used to enhance the bonding of the metal coating and the resin layer. In aspects of the present invention that utilize mechanical bonding between the metal coating layer and the resin layer, useful metal coating layers may include a rough surface. One such rough surface example is spiky nickel. Metal coating layers with relatively smooth surfaces may also be roughened by chemical or mechanical means.

It is contemplated that various mechanical and/or chemical bond configurations can improve retention of the superabrasive grit in the resin layer. It is not required, however, that similar mechanisms act on the resin layer/metal interface and the metal/superabrasive grit interface. For example, the metal coating layer can be bound to the superabrasive grit primarily through chemical bonding, and be bound to the resin layer primarily by mechanical bonding. In other aspects, chemical bonds may play a primary role in bonding the metal coating layer to both the superabrasive grit and to the resin layer. As recited herein, multiple metal coating layers may be utilized to improve the retention of the superabrasive grit in the resin layer. In one aspect, spiky nickel may be utilized to create strong mechanical bonds with at least a portion of the resin layer. An intermediate layer of titanium, tungsten, chromium, or any other useful metal may be deposited on the superabrasive particle prior to electroplating the spiky nickel. The intermediate layer can chemically bond with at least a portion of the superabrasive particle, and metallurgically bond with at least a portion of the spiky nickel layer, thus improving the retention of the superabrasive particle in the resin layer.

In those embodiments utilizing a metal braze alloy as either a primary or an intermediate metal coating layer, a number of reactive elements may be included in a metal braze alloy in order to achieve a desired bonding with the superabrasive particle and/or any additional metal coating layer. A wide variety of reactive elements that can be alloyed with a metallic carrier is known to those skilled in the art, and the selection of a particular reactive element may depend on various factors. Examples of suitable reactive elements for inclusion in a braze alloy used in the present invention include without limitation, members selected from the group consisting of: aluminum (Al), boron (B), chromium (Cr), lithium (Li), magnesium (Mg), molybdenum (Mo), manganese (Mn), nirobium (Nb), silicon (Si), tantalum (Ta), titanium (Ti), vanadium (V), tungsten (W), zirconium (Zr), and mixtures thereof. In addition to the reactive element or elements, a braze alloy used to form a coating in accordance with the present invention may include at least one other metal as a carrier or solvent. Any metal recognized by one of ordinary skill in the art may be used as such a carrier or solvent, especially those known for use in making superabrasive tools. However, by way of example, without limitation, in one aspect of the present invention, such metals may include, cobalt (Co), copper (Cu), iron (Fe), nickel (Ni), and alloys thereof.

As alluded to above, one goal of alloying a reactive element with another metal is to reduce the effective melting point of the reactive element, while maintaining its ability to chemically bond with a superabrasive particle. As is known in the art, the thermal stability limit of many superabrasive materials, such as diamond, ranges from about 900° C. to about 1200° C. As such, in one aspect of the invention, the components and exact ratios of the reactive metal alloy may be selected to provide an alloy that has a melting point within or below the thermal stability limit of the particular superabrasive material being used. In practice, a solvent metal may be selected and combined with a reactive element in proper amounts to reduce the melting temperature of both elements and yield a metal braze alloy having a melting temperature of less than about 1200° C. In yet another aspect, the melting temperature may be below about 900° C. Furthermore, the addition of substantially non-reactive metal materials to the molten braze alloy may reduce superabrasive particle deterioration and thus increase the overall strength of the coated superabrasive particle. Additional discussion of methods that can preserve the strength of coated superabrasive particles used in a tool may be found in copending U.S. Pat. No. 6,830,598; U.S. patent application Ser. No. 10/627,441 filed on Jul. 25, 2003, published as US2005/0230155; and U.S. patent application Ser. No. 11/009,370 filed on Dec. 9, 2004, published as US2005/0108948, all three of which are incorporated herein by reference.

As will be recognized by those of ordinary skill in the art, numerous combinations of specific reactive metals and other specific carrier metals may be alloyed in different ratios or amounts to achieve an alloy that chemically bonds to the superabrasive particle, and has a suitable melting point. However, in one aspect, the content of the reactive element may be at least about 1% of the alloy. In another aspect, the amount of element may be at least about 5% of the alloy.

Turning to resin layers, numerous resin materials are known to those skilled in the art which would be useful when utilized in embodiments of the present invention, and are considered to be included herein. The resin layer can be any curable resin material or resin with sufficient strength to retain the superabrasive grit of the present invention. It may be beneficial to use a resin layer that is relatively hard, and maintains a flat surface with little or no warping. This allows the dresser incorporate very small superabrasive particles at least partially therein, and to maintain these small superabrasive particles at relatively level and consistent heights. Methods of curing can be any process known to one skilled in the art that causes a phase transition in the resin material from at least a pliable state to at least a rigid state. Curing can occur, without limitation, by exposing the resin material to energy in the form of heat, electromagnetic radiation, such as ultraviolet, infrared, and microwave radiation, particle bombardment, such as an electron beam, organic catalysts, inorganic catalysts, or any other curing method known to one skilled in the art. In one aspect of the present invention, the resin layer may be a thermoplastic material. Thermoplastic materials can be reversibly hardened and softened by cooling and heating respectively. In another aspect, the resin layer may be a thermosetting material. Thermosetting materials cannot be reversibly hardened and softened as with the thermoplastic materials. In other words, once curing has occurred, the process is essentially irreversible.

Resin materials that may be useful in embodiments of the present invention include, but are not limited to: amino resins including alkylated urea-formaldehyde resins, melamine-formaldehyde resins, and alkylated benzoguanamine-formaldehyde resins; acrylate resins including vinyl acrylates, acrylated epoxies, acrylated urethanes, acrylated polyesters, acrylated acrylics, acrylated polyethers, vinyl ethers, acrylated oils, acrylated silicons, and associated methacrylates; alkyd resins such as urethane alkyd resins; polyester resins; reactive urethane resins; phenolic resins such as resole and novolac resins; phenolic/latex resins; epoxy resins such as bisphenol epoxy resins; isocyanate resins; isocyanurate resins; polysiloxane resins including alkylalkoxysilane resins; reactive vinyl resins; resins marketed under the Bakelite trade name, including polyethylene resins, polypropylene resins, epoxy resins, phenolic resins, polystyrene resins, phenoxy resins, perylene resins, polysulfone resins, ethylene copolymer resins, acrylonitrile-butadiene-styrene (ABS) resins, acrylic resins, and vinyl resins; acrylic resins; polycarbonate resins; and mixtures and combinations thereof. In one aspect of the present invention, the resin may be an epoxy resin. In another aspect, the resin material may be a polyimide resin. In yet another aspect, the resin material may be a polycarbonate resin. In yet another aspect, the resin material may be a polyurethane resin.

Numerous additives may be included in the resin material to facilitate its use. For example, additional crosslinking agents and fillers may be used to improve the cured characteristics of the resin layer. Additionally, solvents may be utilized to alter the characteristics of the resin material in the uncured state. In one aspect, bonding of the metal coating layer to the resin layer may be facilitated by including an organometalic compound in at least a portion of the resin layer.

The superabrasive particles used in embodiments of the present invention may be selected from a variety of specific types of diamond (e.g., polycrystalline diamond) and cubic boron nitride (e.g., polycrystalline cBN). It may be useful to select a superabrasive material capable of chemically bonding with a reactive material, such as those described herein. Further, these particles may take a number of different shapes as required to accommodate a specific purpose for the tool into which it is anticipated that they will be incorporated. However, in one aspect, the superabrasive particle may be diamond, including natural diamond, synthetic diamond, and polycrystalline diamond (PCD). In yet another aspect, the superabrasive particle may be cubic boron nitride (cBN), either single crystals or polycrystalline. In yet another aspect, the superabrasive particle may be a member selected from the group consisting of SiC, $Al_2O_3$, Zr $O_2$, and WC.

Numerous uses of aspects of the present invention will be apparent to one skilled in the art in possession of the present disclosure. Coated superabrasive particles can be arranged into tools of various shapes and sizes, including one-, two-, and three-dimensional tools. Tools may incorporate a single layer or multiple layers of coated superabrasive particles. One example of a tool incorporating a single layer of coated superabrasive particles in a resin matrix is a CMP pad dresser.

As recited herein, traditional metal matrix CMP pad dressers are not suitable for bonding very small superabrasive particles. It is intended that the scope of the present invention include superabrasive particles of all conceivable sizes that would be useful in dressing a CMP pad. Aspects of the present invention, however, specifically allow the retention of superabrasive particles in a CMP pad dresser of sizes that have not previously been feasible for use in metal tools with particles exposed and arranged in a pattern. In one aspect, superabrasive particles may range in size from about 30 microns to about 200 microns. In another aspect, superabrasive particles may range in size from about 100 microns to about 150 microns.

Figure 2:
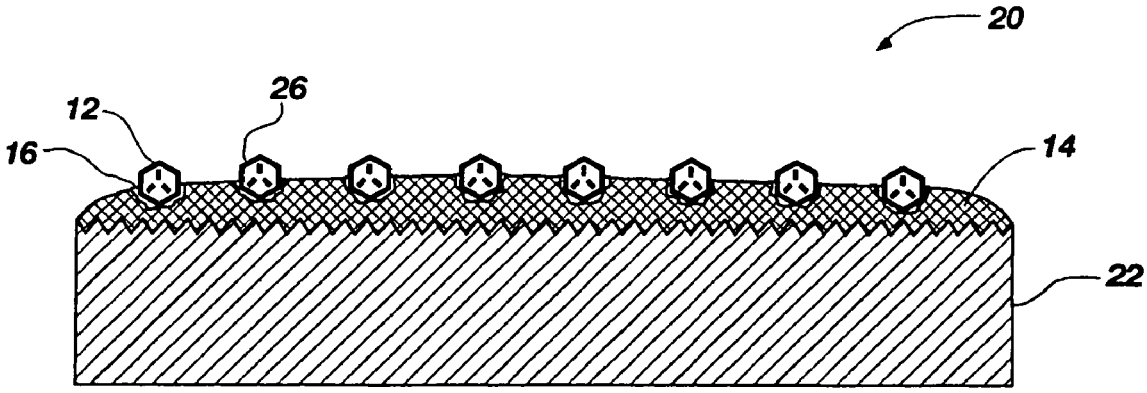
FIG. 2 is a cross-sectional view of a CMP pad dresser made in accordance with one embodiment of the present invention.

Embodiments of the present invention also provide CMP pad dressers with improved superabrasive grit retention as recited herein. Referring to FIG. 2, the CMP pad dresser 20 may include a resin layer 14, superabrasive grit 12 held in the resin layer 14 according to a predetermined pattern, and a metal coating layer 16 disposed between each superabrasive grit 12 and the resin layer 14. As recited herein, the metal coating layer 16 increases the retention of the superabrasive grit 12 in the resin layer 14 as compared to superabrasive grit absent the metal coating layer. In one aspect the resin layer 14 may be coupled to a support substrate 22.

In order for the CMP pad dresser 20 to condition a CMP pad, the superabrasive grit 12 should protrude at least partially from the resin layer 14. The protruding superabrasive grit 12 can cut into the CMP pad to a depth that is essentially the distance of the protrusion. In one aspect of the present invention, the superabrasive grit can protrude to a predetermined height. The heights of each superabrasive grit can be essentially the same, or they may vary depending on the particular application of the dresser. For example, superabrasive grit near the center of the CMP pad dresser may protrude to a greater height than the superabrasive grit near the dresser periphery.

The conditioning action of the CMP pad dresser may be enhanced if the protruding superabrasive grit 12 is at least partially exposed, i.e. free of the metal coating layer 16. In one aspect of the present invention, at least a portion of a protruding surface area 26 of each superabrasive grit 12 may be essentially free of the metal coating layer 16. In another aspect, essentially all of the protruding surface area 26 of each superabrasive grit 12 may be essentially free of the metal coating layer 16. The metal coating layer 16 may be removed from the protruding surface area 26 by any means known to one skilled in the art, including grinding, buffing, acid etching, sandblasting, etc.

Various methods for making a CMP pad dresser according to embodiments of the present invention may be contemplated by one of skill in the art. Generally, a method for making a CMP pad dresser may include disposing superabrasive grit in a resin layer according to a predetermined pattern such that the superabrasive grit protrude at least partially from the resin layer. As described herein, the superabrasive grit is coated with a metal coating layer disposed at least between the superabrasive grit and the resin layer to improve retention. In one aspect of the present invention, a reinforcing material may be applied to at least a portion of the resin layer in the proximity of the superabrasive grit prior to curing the resin material. The reinforcing material may protect the resin layer from acid and provide wear resistance. In one aspect, the reinforcing material is a ceramic powder. The ceramic powder may be any ceramic powder known to one skilled in the art, including alumina, aluminum carbide, silica, silicon carbide, zirconia, zirconium carbide, and mixtures thereof. In one aspect the ceramic powder is silicon carbide. In another aspect, the ceramic powder is aluminum carbide. In yet another aspect, the ceramic powder is silica.

Disposing superabrasive grit according to a predetermined pattern may be accomplished by applying spots of glue to a substrate, by creating indentations in the substrate to receive the particles, or by any other means known to one skilled in the art. Additional methods may be found in U.S. Pat. Nos. 6,039,641 and 5,380,390, which are incorporated herein by reference.

Figure 3:
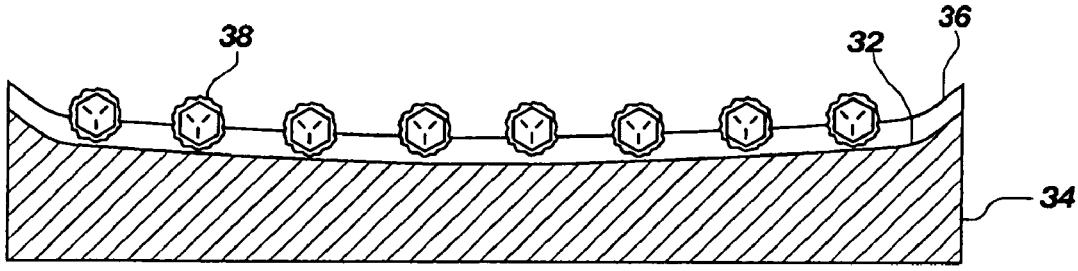
FIG. 3 is a cross-sectional view of metal coated superabrasive particles disposed on a temporary substrate in accordance with one embodiment of the present invention.
Figure 4:
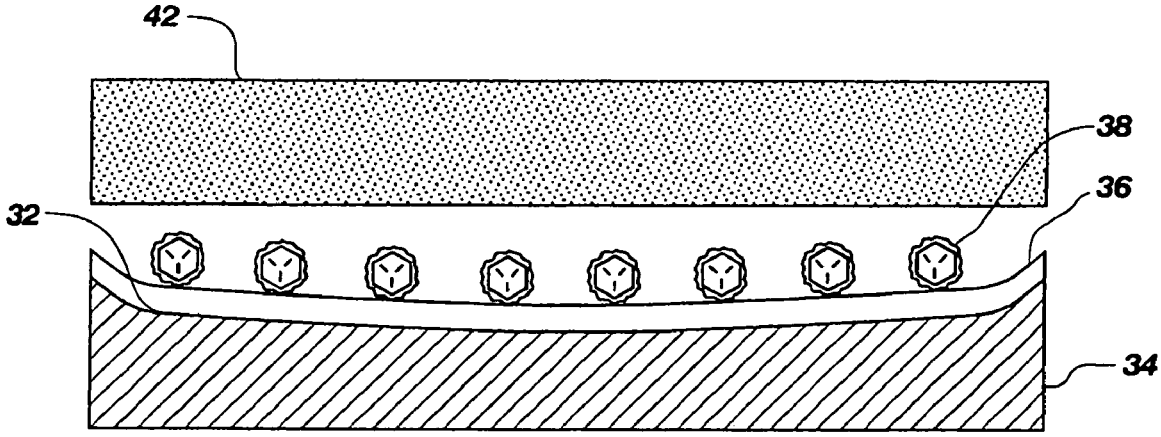
FIG. 4 is a cross-sectional view of metal coated superabrasive particles disposed on a temporary substrate in accordance with one embodiment of the present invention.

Various reverse casting methods may be utilized to manufacture the CMP pad dresser of the present invention. As shown in FIG. 3, a spacer layer 36 may be applied to a working surface 32 of a temporary substrate 34. The spacer layer 36 has metal coated superabrasive grit 38 at least partially disposed therein, which protrude at least partially from the spacer layer 36 opposite the working surface 32 of the temporary substrate 34. Any method of disposing metal coated superabrasive grit into a spacer layer such that the superabrasive grit protrude to a predetermined height may be utilized in the present invention. In one aspect, as shown in FIG. 4, the spacer layer 36 is disposed on working surface 32 of the temporary substrate 34. A fixative may be optionally applied to the working surface 32 to facilitate the attachment of the spacer layer 36 to the temporary substrate 34. Superabrasive grit 38 is disposed along one side of the spacer layer 36 opposite to the working surface 32. A fixative may be optionally applied to the spacer layer 36 to hold the superabrasive grit 38 essentially immobile along the spacer layer 36. The fixative used on either surface of the spacer layer may be any adhesive known to one skilled in the art, such as, without limitation, a polyvinyl alcohol (PVA), a polyvinyl butyral (PVB), a polyethylene glycol (PEG), a pariffin, a phenolic resin, a wax emulsion, an acrylic resin, or combinations thereof. In one aspect, the fixative is a sprayed acrylic glue.

A press 42 may be utilized to apply force to the superabrasive grit 38 in order to dispose the superabrasive grit 38 into the spacer layer 32 as shown in FIG. 3. The press 42 may be constructed of any material know to one skilled in the art able to apply force to the superabrasive grit 38. Examples include, without limitation, metals, wood, plastic, rubber, polymers, glass, composites, ceramics, and combinations thereof. Depending on the application, softer materials may provide a benefit over harder materials. For example, if unequal sizes of superabrasive particles are used, a hard press may only push the largest superabrasive particles through the spacer layer 36 to the working surface 32. In one aspect of the present invention, the press 42 is constructed of a porous rubber. A press 42 constructed from a softer material such as a hard rubber, may conform slightly to the shape of the superabrasive grit 38, and thus more effectively push smaller as well as larger superabrasive particles through the spacer layer 36 to the working surface 32.

The spacer layer may be made from any soft, deformable material with a relatively uniform thickness. Examples of useful materials include, but are not limited to, rubbers, plastics, waxes, graphites, clays, tapes, grafoils, metals, powders, and combinations thereof. In one aspect, the spacer layer may be a rolled sheet comprising a metal or other powder and a binder. For example, the metal may be a stainless steel powder and a polyethylene glycol binder. Various binders can be utilized, which are well known to those skilled in the art, such as, but not limited to, a polyvinyl alcohol (PVA), a polyvinyl butyral (PVB), a polyethylene glycol (PEG), a pariffin, a phenolic resin, a wax emulsions, an acrylic resin, and combinations thereof.

Figure 5:
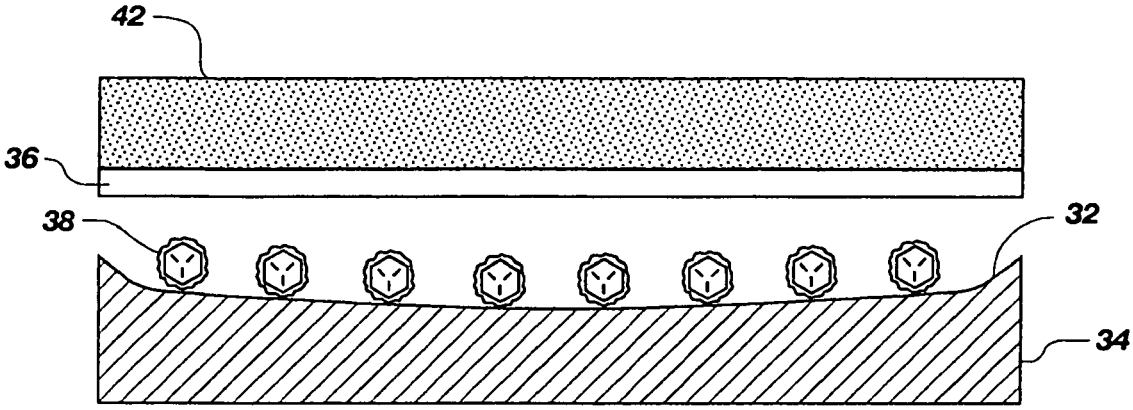
FIG. 5 is a cross-sectional view of metal coated superabrasive particles disposed on a temporary substrate in accordance with one embodiment of the present invention.

In another aspect, shown in FIG. 5, the metal coated superabrasive grit 38 may be disposed along the working surface 32 of the temporary substrate 34. An adhesive may be optionally applied to the working surface 32 to hold the superabrasive grit 38 essentially immobile along the temporary substrate 34. A spacer layer 36 may then be applied to the working surface 32 such that the superabrasive grit 38 become disposed therein, as shown in FIG. 3. A press 42 may be utilized to more effectively associate the spacer layer 36 with the working surface 32 and the superabrasive grit 38.

Figure 6:
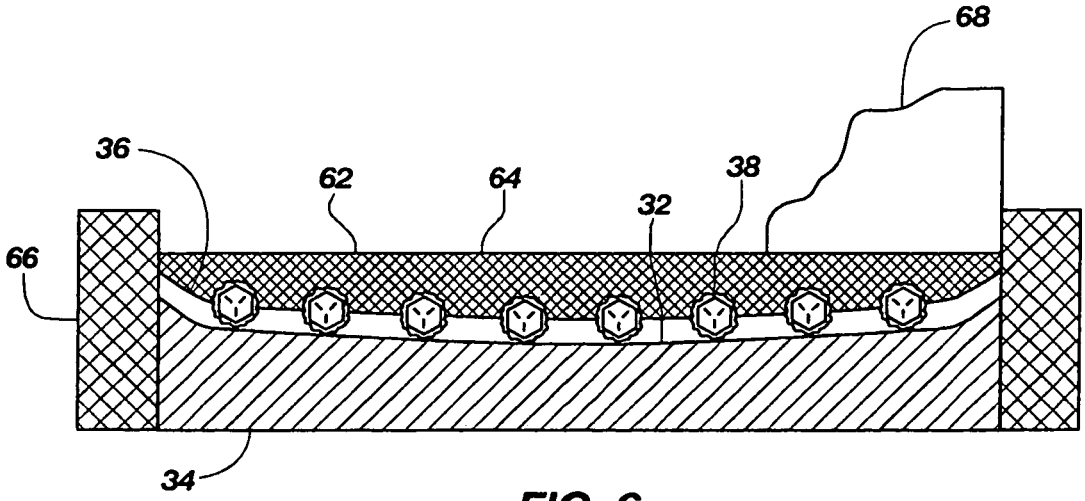
FIG. 6 is a cross-sectional view metal coated superabrasive particles disposed in a resin layer in accordance with one embodiment of the present invention.

Referring now to FIG. 6, an at least partially uncured resin material 62 may be applied to the spacer layer 36 opposite the working surface 32 of the temporary substrate 34. A mold 66 may be utilized to contain the uncured resin material 62 during manufacture. Upon curing the resin material 62, a resin layer 64 is formed, bonding at least a portion of each superabrasive particle 38. A permanent substrate 68 may be coupled to the resin layer 64 to facilitate its use in dressing a CMP pad. In one aspect, the permanent substrate 68 may be coupled to the resin layer 64 by means of an appropriate fixative. The coupling may be facilitated by roughing the contact surfaces between the permanent substrate 68 and the resin layer 64. In another aspect, the permanent substrate 68 may be associated with the resin material 62, and thus become coupled to the resin layer 64 as a result of curing. The mold 66 and the temporary substrate 34 can subsequently be removed from the CMP pad dresser.

Figure 7:
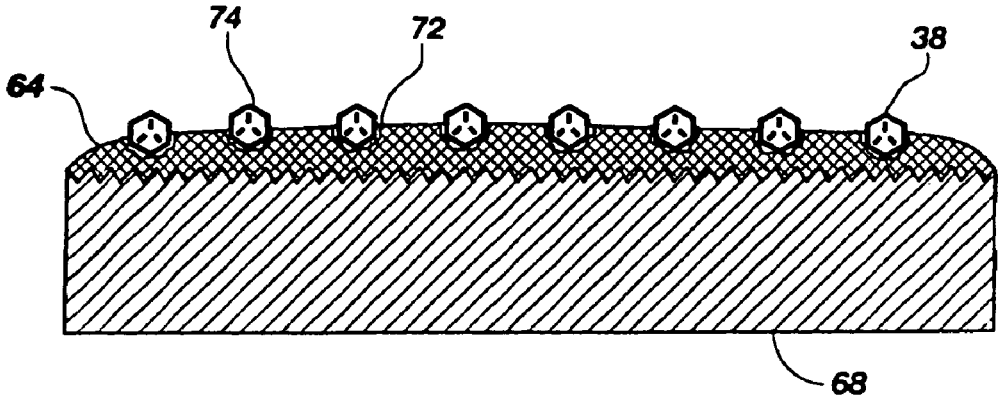
FIG. 7 is a cross-sectional view of a CMP pad dresser in accordance with one embodiment of the present invention.

As shown in FIG. 7, the spacer layer has been removed from the resin layer 64. This may be accomplished by peeling, grinding, sandblasting, scraping, rubbing, abrasion, etc. Portions of the metal coating layer 72 located on the protruding end 74 of the superabrasive grit 38 may be removed by acid etching, grinding, sandblasting, or any other process known to one skilled in the art. The distance of the protrusion of the superabrasive grit 38 from the resin layer 64 will be approximately equal to the thickness of the now removed spacer layer. The resin layer 64 may be acid etched to further expose the superabrasive grit 38.

One distinction between the various methods of disposing superabrasive grit into the spacer layer may be seen upon removal of the spacer layer. In those aspects where the superabrasive grit is pressed into the spacer layer, the spacer layer material in close proximity to a superabrasive particle will be deflected slightly towards the working surface of the temporary substrate. In other words, the spacer layer material surrounding an individual superabrasive particle may be slightly concave on the side opposite of the working surface due to the superabrasive particle being pushed into the spacer layer. This concave depression will be filled with resin material during the manufacture of the dresser, and thus the resin material will wick up the sides of the superabrasive particle once the resin layer is cured. For those aspects where the spacer layer is pressed onto the superabrasive grit, the opposite is true. In these cases, the spacer layer material in close proximity to a superabrasive particle will be deflected slightly away from the working surface of the temporary substrate. In other words, the spacer layer material surrounding an individual superabrasive particle may be slightly convex on the side opposite of the working surface due to the spacer layer being forced around the superabrasive particle. This convex protrusion may cause a slight concave depression in the resin layer surrounding each superabrasive particle. This slight concave depression may decrease retention, resulting in premature superabrasive grit pullout from the resin layer. For these aspects, various means of improving retention may be employed by one skilled in the art. For example, the spacer layer may be heated to reduce the slightly convex protrusion of the spacer layer surrounding a superabrasive particle prior to curing the resin layer. Also, additional resin material may be applied to the slight concave depression in the resin layer surrounding the superabrasive particle.

The temporary substrate may be made of any material capable of supporting the resin layer and withstanding the force of the press as described herein. Example materials include glasses, metals, woods, ceramics, polymers, rubbers, plastics, etc. Referring back to FIG. 3, the temporary substrate 34 has a working surface 32 upon which the spacer layer 36 is applied. The working surface 32 can be level, sloped, flat, curved, or any other shape that would be useful in the manufacture of a CMP pad dresser. The working surface 32 may be roughened to improve the orientation of the superabrasive grit 38. When a superabrasive particle is pressed onto a very smooth temporary substrate, it may be more likely that a flat surface of the superabrasive particle will align parallel to the temporary substrate. In this situation, when the spacer layer is removed the flat surface of the superabrasive particle will protrude from the resin layer. Roughening the surface of the temporary substrate will create pits and valleys that may help to align the superabrasive grit such that the tips of individual superabrasive particle will protrude from the resin layer.

Figure 8:
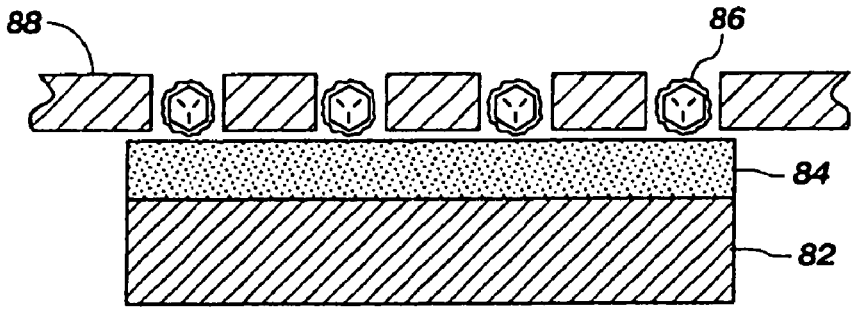
FIG. 8 is a cross-sectional view metal coated superabrasive particles disposed along a layer of resin material in accordance with one embodiment of the present invention.

An alternative aspect of the present invention comprises a method of disposing superabrasive grit in a resin layer. The method may include providing an resin material arranged as a layer, disposing superabrasive grit on the resin material, pressing the superabrasive grit into the resin material, and curing the resin material to form a resin layer. FIG. 8 shows a permanent substrate 82 upon which a layer of resin material 84 is applied. Metal coated superabrasive grit 86 is disposed along the surface of the layer of resin material 84. A fixative may be utilized to at least partially immobilize the superabrasive grit 86 to the layer of resin material 84. The superabrasive grit 86 may be arranged according to a predetermined pattern by any means known to one skilled in the art. FIG. 8 shows superabrasive particles arranged by means of a template 88.

Figure 9:
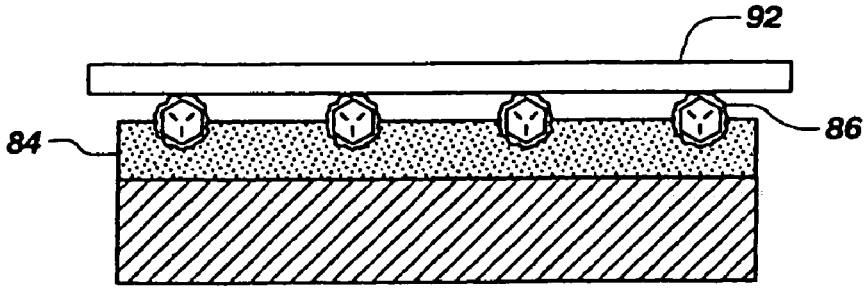
FIG. 9 is a cross-sectional view metal coated superabrasive particles being pressed into a layer of resin material in accordance with one embodiment of the present invention.

Turning to FIG. 9, a press 92 may be utilized to dispose the superabrasive grit 86 at least partially into the layer of resin material 84. In one aspect, the superabrasive grit 86 protrudes above the layer of resin material 84 to a predetermined height. The layer of resin material 84 is subsequently cured to form a solidified resin layer. In one aspect the resin layer is a thermoplastic resin. In this case the thermoplastic can be softened by heating in order to receive the superabrasive grit 86, and subsequently cooled to cure the thermoplastic into a solidified resin layer. The layer of resin material 84 can be any resin material known to one skilled in the art, with the proviso that the uncured resin material be viscous enough to support the superabrasive grit prior to curing, or another form of physical support for the superabrasive grit be provided. Upon curing of the layer of resin material 84, at least a portion of the metal coating can be removed from at least a portion of the protruding superabrasive grit 86, as described herein.

The following examples present various methods for making the coated superabrasive particles and tools of the present invention. Such examples are illustrative only, and no limitation on present invention is meant thereby.

EXAMPLES

Example 1

Diamond grit having an average size of about 65 microns are coated with nickel by an electroless process (with hypophosphate reducing agent) to form a spiky exterior of about 130 microns. The coated diamond grit are arranged with a template to stick on a 100 mm diameter, 10 mm thick flat base plate. The coated diamond grit form a grid pattern with an inter-diamond pitch of 500 microns. The plate is placed at the bottom of a steel mold and covered with a polyimide resin powder. Subsequently, the entire assembly is pressed to 50 MPa pressure and 350° C. for 10 minutes. The polyimide consolidated plate is 7 mm thick with nickel coated diamond grit forming a grid on one side. A conventional grinding wheel with silicon carbide grit is used to grind the surface to expose the nickel coated diamond to about 60 microns. Subsequently, an aqua regia solution is used to dissolve the remaining nickel that is exposed above the polyimide resin surface. The final product is a pad conditioner with diamond exposed. The diamond is firmly embedded in the spiky nickel coating that in turn is securely bonded by the polyimide.

Example 2

The same procedure is followed as Example 1, however a phenolic resin is used in place of the polyimide resin, and the forming temperature is reduced to 200° C.

Example 3

The same procedure is followed as Example 1, however the base plate is precoated with a layer of clay that is about 60 microns thick. After hot pressing, the clay is scraped off, exposing the nickel coated diamond protruding from the polyimide resin layer. The diamond is then exposed by etching the nickel with acid.

Example 4

The same procedure is followed as Example 1, however the diamond is precoated with 0.5 micron of titanium and heat treated at 700° C. for 30 minutes to form TiC at the interface for increased bonding strength after coating with nickel.

Example 5

The same procedure is followed as Example 1, however the pressed polyimide resin disk is 1 mm thick and is glued on a 420 stainless steel backing to form a pad conditioner.

Example 6

Diamond grit of about 65 microns in size are coated with spiky nickel to reach an average size of about 130 microns. The coated grit are mixed with an epoxy binder to form a slurry. The slurry is spread over a polyethylene terephthalate (PET) sheet. A blade is used to thin the slurry so that it contains one layer of coated diamond. The epoxy is then cured by an UV light to harden. Subsequently, circular disks are punched out of the epoxy sheet. The disks are glued with an acrylic onto stainless steel substrates with the diamond facing away from the glue. A fine sand paper is used to polish the exposed surface and remove the epoxy until approximately half the height of the nickel coating is exposed. An aqua regia solution is used to etch away the exposed nickel, thus exposing the diamond. The final product is a pad conditioner with diamond grit securely embedded in an epoxy matrix.

Example 7

Diamond grit of about 65 microns in size are coated with spiky nickel to reach an average size of about 130 microns. The nickel coated diamond grit are then arranged by a template on a PET sheet. Subsequently, an epoxy resin is deposited to cover the single layer of grits. After curing, the PET sheet is punched to form disks. The disks are then glued on stainless steel substrates, and the top surface is then sanded off and etched by acid.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of improving retention of superabrasive grit held in a solidified resin layer, comprising:

disposing a metal coating layer between at least a portion of each superabrasive grit and the resin layer such that each superabrasive grit includes an exposed portion that protrudes at least partially from the resin layer, the exposed portion being substantially free of the metal coating layer.

2. The method of claim 1, wherein the metal coating layer is a single layer.

3. The method of claim 1, wherein the metal coating layer is an alloy.

4. The method of claim 1, wherein the metal coating layer includes multiple layers.

5. The method of claim 1, wherein at least a portion of the metal coating layer chemically bonds to each superabrasive grit, and at least a portion of the metal coating layer mechanically bonds to the resin layer.

6. The method of claim 1, wherein at least a portion of the metal coating layer has a surface that provides increased mechanical bonding by the resin layer as compared to the resin layer bonding to a superabrasive grit surface.

7. The method of claim 6, wherein at least a portion of the metal coating layer has a rough surface.

8. The method of claim 7, wherein the rough surface is spiky nickel.

9. The method of claim 1, wherein the metal coating layer is cobalt, copper, nickel, including alloys and mixtures thereof.

10. The method of claim 1, wherein the superabrasive grit are held in the resin layer according to a predetermined pattern.

11. The method of claim 1, wherein the superabrasive grit is diamond.

12. The method of claim 1, wherein the superabrasive grit is cBN.

13. The method of claim 1, wherein the superabrasive grit is from about 30 microns to about 200 microns in size.

14. The method of claim 13, wherein the superabrasive grit is from about 100 microns to about 150 microns in size.

15. A CMP pad dresser with improved superabrasive grit retention comprising:

a resin layer;

superabrasive grit held in the resin layer, each superabrasive grit including an exposed portion that protrudes at least partially from the resin layer; and a metal coating layer disposed between at least a portion of each superabrasive grit and the resin layer such that the exposed portion of each superabrasive grit is substantially free of the metal coating layer, the metal coating layer increasing retention of the superabrasive grit as compared to superabrasive grit absent the metal coating layer.

16. The CMP pad dresser of claim 15, wherein the metal coating layer extends substantially along each superabrasive grit and resin layer interface.

17. The CMP pad dresser of claim 15, wherein the superabrasive grit protrude substantially to a predetermined height.

18. The CMP pad dresser of claim 15, wherein the metal coating layer is a single layer.

19. The CMP pad dresser of claim 15, wherein the metal coating layer is an alloy.

20. The CMP pad dresser of claim 15, wherein the metal coating layer includes multiple layers.

21. The CMP pad dresser of claim 15, wherein at least a portion of the metal coating layer is chemically bonded to each superabrasive grit, and at least a portion of the metal coating layer is mechanically bonded to the resin layer.

22. The CMP pad dresser of claim 15, wherein at least a portion of the metal coating layer has a rough surface.

23. The CMP pad dresser of claim 22, wherein the rough surface is spiky nickel.

24. The CMP pad dresser of claim 15, wherein the metal coating layer is cobalt, copper, nickel, including alloys and mixtures thereof.

25. The CMP pad dresser of claim 15, wherein the resin layer comprises a member selected from the group consisting of amino resins, acrylate resins, alkyd resins, polyester resins, reactive urethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

26. The CMP pad dresser of claim 25, wherein the resin layer is an epoxy resin.

27. The CMP pad dresser of claim 25, wherein the resin layer is a polycarbonate resin.

28. The CMP pad dresser of claim 25, wherein the resin layer is a polyimide resin.

29. The CMP pad dresser of claim 15, wherein the superabrasive grit is diamond.

30. The CMP pad dresser of claim 15, wherein the superabrasive grit is cBN.

31. The CMP pad dresser of claim 15, wherein the superabrasive grit is from about 30 microns to about 200 microns in size.

32. The CMP pad dresser of claim 31, wherein the superabrasive grit is from about 100 microns to about 150 microns in size.

33. A method for making a CMP pad dresser of claim 15, comprising:

disposing superabrasive grit in a resin layer such that each superabrasive grit has an exposed portion that protrudes at least partially from the resin layer, the superabrasive grit including a metal coating layer disposed between at least a portion of the superabrasive grit and the resin layer, such that the exposed portion of each superabrasive grit is substantially free of the metal coating layer; and curing the resin layer.

34. The method of claim 33, wherein the superabrasive grit are disposed in the resin layer according to a predetermined pattern.

35. The method of claim 33, wherein the superabrasive grit protrude essentially to a predetermined height.

36. The method of claim 35, wherein disposing superabrasive grit in a resin layer further comprises:

providing a temporary substrate having a working surface;

applying a spacer layer to the working surface of the temporary substrate;

depositing the superabrasive grit into the spacer layer such that each superabrasive grit is partially disposed within the spacer layer and each superabrasive grit partially protrudes from the spacer layer opposite the working surface of the temporary substrate;

applying an at least partially uncured resin material to the spacer layer opposite the working surface of the temporary substrate;

curing the at least partially uncured resin material to form a resin layer such that the protruding portion of each superabrasive grit is embedded in the resin layer;

removing the temporary substrate from the spacer layer; and removing the spacer layer from the resin layer such that the superabrasive grit remain embedded in the resin layer.

37. The method of claim 36, further comprising roughing the working surface of the temporary substrate prior to application of the spacer layer and the superabrasive grit.

38. The method of claim 33, wherein disposing superabrasive grit in a resin layer further comprises:

providing an resin material arranged as a layer;

disposing superabrasive grit on the resin material;

pressing the superabrasive grit into the resin material; and curing the resin material to form a resin layer.

39. The method of claim 38, wherein curing the resin material further includes:

heating the resin material such that the resin material at least partially flows around the superabrasive grit; and cooling the resin material to form a resin layer.

40. The method of claim 33, further comprising removing the metal coating layer from the exposed portion by etching the resin layer to expose the superabrasive grit.

41. The method of claim 33, further comprising applying a reinforcing material to at least a portion of the resin layer in proximity to the superabrasive grit prior to curing.

42. The method of claim 41, wherein the reinforcing material is a ceramic powder.

43. The method of claim 42, wherein the ceramic powder comprises a member selected from the group consisting of alumina, aluminum carbide, silica, silicon carbide, zirconia, zirconium carbide, and mixtures thereof.

44. The method of claim 43, wherein the ceramic powder is silicon carbide.

45. The method of claim 43, wherein the ceramic powder is aluminum carbide.

46. The method of claim 43, wherein the ceramic powder is silica.

47. The method of claim 33, further comprising adding an organometallic coupling agent to at least a portion of the resin layer prior to curing.

48. The method of claim 33, wherein the resin layer comprises a member selected from the group consisting of amino resins, acrylate resins, alkyd resins, polyester resins, reactive urethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and mixtures thereof.

49. The method of claim 48, wherein the resin layer is an epoxy resin.

50. The method of claim 48, wherein the resin layer is a polycarbonate resin.

51. The method of claim 48, wherein the resin layer is a polyimide resin.

52. The method of claim 33, wherein the superabrasive grit is diamond.

53. The method of claim 33, wherein the superabrasive grit is cBN.

* * * * *